US012215611B1

(12) United States Patent
Burcar et al.

(10) Patent No.: US 12,215,611 B1
(45) Date of Patent: Feb. 4, 2025

(54) SPACER EQUIPPED TO SPRAY OIL AND ROCKER ARM ASSEMBLY FOR VALVETRAIN

(71) Applicant: Caterpillar Inc., Peoria, IL (US)

(72) Inventors: Quinton Burcar, Chillicothe, IL (US); Michael D. Roley, Washington, IL (US); Paul K. Stark, Peoria, IL (US); Ram P. Anjaneyulu, Chennai Tamil Nadu (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/610,672

(22) Filed: Mar. 20, 2024

(51) Int. Cl.
*F01M 9/10* (2006.01)
*F01L 1/18* (2006.01)

(52) U.S. Cl.
CPC ..... *F01M 9/10* (2013.01); *F01L 1/181* (2013.01); *F01M 9/105* (2013.01)

(58) Field of Classification Search
CPC ..... F01L 1/181; F01M 9/10; F01M 9/105
USPC ..... 123/90.36
See application file for complete search history.

(56) References Cited

U.S. PATENT DOCUMENTS

| | | | | |
|---|---|---|---|---|
| 5,394,842 | A | 3/1995 | Kobayashi | |
| 6,230,676 | B1 | 5/2001 | Pryba et al. | |
| 6,352,062 | B1 | 3/2002 | Ferrea | |
| 9,394,914 | B2 | 7/2016 | Kirk et al. | |
| 9,726,282 | B2 | 8/2017 | Pohl et al. | |
| 11,066,962 | B1 * | 7/2021 | Newell | F01M 9/101 |

FOREIGN PATENT DOCUMENTS

| | | | | |
|---|---|---|---|---|
| CN | 210239770 | U | 4/2020 | |
| CN | 110700913 | B | 1/2022 | |
| JP | 6508976 | B2 | 5/2019 | |
| WO | WO-2013020358 | A1 * | 2/2013 | F01L 1/181 |

* cited by examiner

*Primary Examiner* — Jorge L Leon, Jr.
(74) *Attorney, Agent, or Firm* — Brannon Sowers & Cracraft PC

(57) ABSTRACT

A spacer for a valvetrain in an engine system includes a spacer body defining a spacer axis extending between a first axial spacer body end and a second axial spacer body end, and including an outer peripheral surface, a circumferentially extending inner peripheral surface forming a throughbore, an oil spray port extending from the inner peripheral surface to the outer peripheral surface, and a circumferentially extending fluid groove formed in the inner peripheral surface and extending to the oil spray port. Related valvetrain and rocker arm assembly apparatus is also disclosed.

17 Claims, 3 Drawing Sheets

SPACER EQUIPPED TO SPRAY OIL AND ROCKER ARM ASSEMBLY FOR VALVETRAIN

TECHNICAL FIELD

The present disclosure relates generally to a valvetrain assembly for an engine, and more particularly to a spacer for a rocker arm equipped to spray oil.

BACKGROUND

Internal combustion engines typically include valvetrains to control the opening and closing of intake and exhaust valves and sometimes actuate fuel injectors. In general terms, intake and exhaust valves regulate the flow of air and/or an air and fuel mixture and exhaust, respectively, into and out of a combustion cylinder. Over the course of an engine cycle, the valvetrain controls opening and closing of intake valves, permitting fresh air and/or an air and fuel mixture to enter into combustion cylinders, and opens and closes exhaust valves to remove combustion products. Where direct fuel injectors are used, the valvetrain may operate the fuel injectors for pressurization of a fuel to an injection pressure. In a typical configuration one or more rotatable camshafts are coupled to rocker arms that are pivoted upon a rocker shaft to actuate the subject engine valve and fuel injector components. The reliable operation of valvetrain components is crucial for timing of engine events to ensure optimal engine operation.

In recent years, engineers have been motivated to modify existing engine platforms to, for example, operate with reduced levels of certain emissions, take advantage of new and/or different fuels, or to operate in different applications. Natural gas and certain other gaseous fuels may be associated with perceived benefits such as reductions in certain emissions, notably particulate matter. The modifications may include adjustments to the fuel injection system, including variations in the parts and sometimes functions of the valvetrain components. Valvetrain apparatuses generally include numerous different components that must be mounted and operated in a relatively tight packaging space. The size and configuration of the packaging space can be altered as compared to an existing platform where components are added or removed. Other factors can also be affected including lubrication and/or cooling requirements.

One known lubricating spacer that is used in a valvetrain is set forth in U.S. Pat. No. 6,230,676 to Toledo Technologies Inc. In the Toledo patent, a spacer sleeve for a rocker arm is disclosed. A central mounting shaft is formed from a series of relatively short, hardened shafts connected together. The connection is apparently facilitated by the spacer sleeve to support the shaft segments. While the design set forth in the '676 patent may have certain applications, there is always room for improvements and/or developments of alternative strategies.

SUMMARY

In one aspect, a valvetrain assembly includes a camshaft, a rocker shaft having therein a longitudinally extending oil passage, a plurality of rocker arms upon the rocker shaft and a spacer positioned upon the rocker shaft adjacent to one of the plurality of rocker arms. The spacer defines a spacer axis and includes an outer peripheral surface and a circumferentially extending inner peripheral surface forming a through-bore. The spacer further includes an oil spray port extending from the inner peripheral surface to the outer peripheral surface. A circumferentially extending fluid groove is defined between the spacer and the rocker shaft and fluidly connects the longitudinally extending oil passage to the oil spray port.

In another aspect, a rocker arm assembly includes a rocker arm and a spacer, the spacer having a spacer body with a first body portion and a second body portion. The first body portion defines a spacer axis and includes an outer peripheral surface and a circumferentially extending inner peripheral surface forming a through-bore. The spacer further includes an oil spray port extending from the inner peripheral surface to the outer peripheral surface. The spacer further includes a circumferentially extending fluid groove formed in the inner peripheral surface and extending to the oil spray port. The second body portion includes an arm extending outwardly from the first body portion and coupling the spacer to the rocker arm.

In yet another aspect, a spacer for a valvetrain in an engine system includes a spacer body defining a spacer axis extending between a first axial spacer body end and a second axial spacer body end. The spacer further includes an outer peripheral surface and a circumferentially extending inner peripheral surface forming a through-bore. The spacer further includes an oil spray port extending from the inner peripheral surface to the outer peripheral surface, and a circumferentially extending fluid groove formed in the inner peripheral surface and extending to the oil spray port.

DETAILED DESCRIPTION

Figure 1:
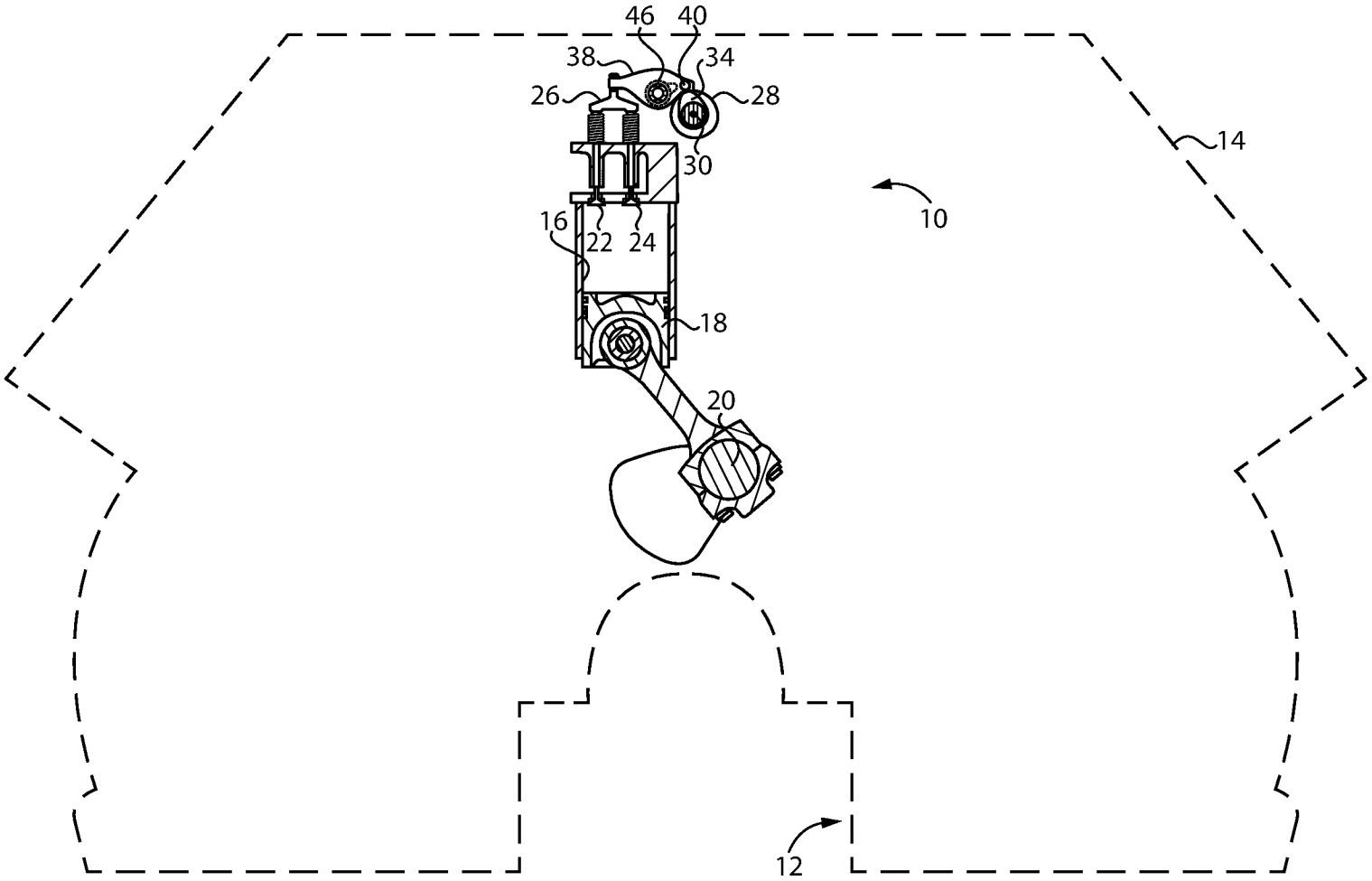
FIG. 1 is a partially sectioned diagrammatic view of a valvetrain assembly in an internal combustion engine, according to one embodiment.

Referring to FIG. 1, illustrated is a valvetrain assembly or valvetrain 10 in an internal combustion engine 12. Internal combustion engine 12 includes an engine housing 14 having a cylinder 16 formed therein, and a piston 18 movable in cylinder 16. Engine 12 further includes a piston 18 coupled with a crankshaft 20 in a generally conventional manner. Engine 12 also includes a plurality of engine valves 22 and 24. Cylinder 16 may be associated with two intake valves, and two exhaust valves, although the present disclosure is not strictly limited as such. As illustrated, engine valves 22 and 24 are coupled together by way of a valve bridge 26. Thus, it will be appreciated that FIG. 1 can be understood to illustrate two exhaust valves or two intake valves, and additional engine valves are not visible in the illustration. Valvetrain 10 is structured to open and close engine valves 22 and 24 together in response to rotation of a camshaft 28 about a camshaft axis 30. Cylinder 16 may be one of any number of cylinders 16 arranged in engine 12 in any configuration such as a V-pattern, an inline pattern, or still another.

Figure 2:
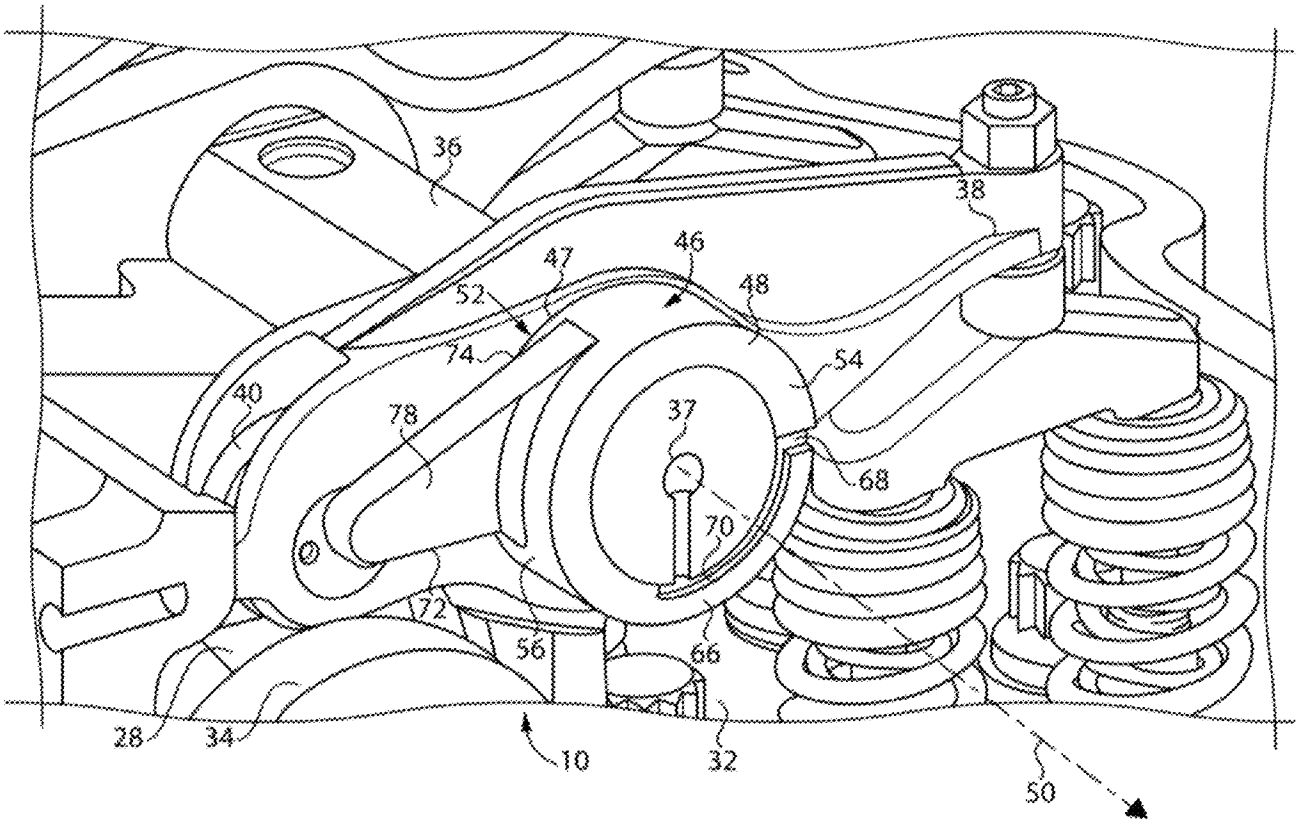
FIG. 2 is a perspective view of a valvetrain assembly, according to one embodiment.
Figure 3:
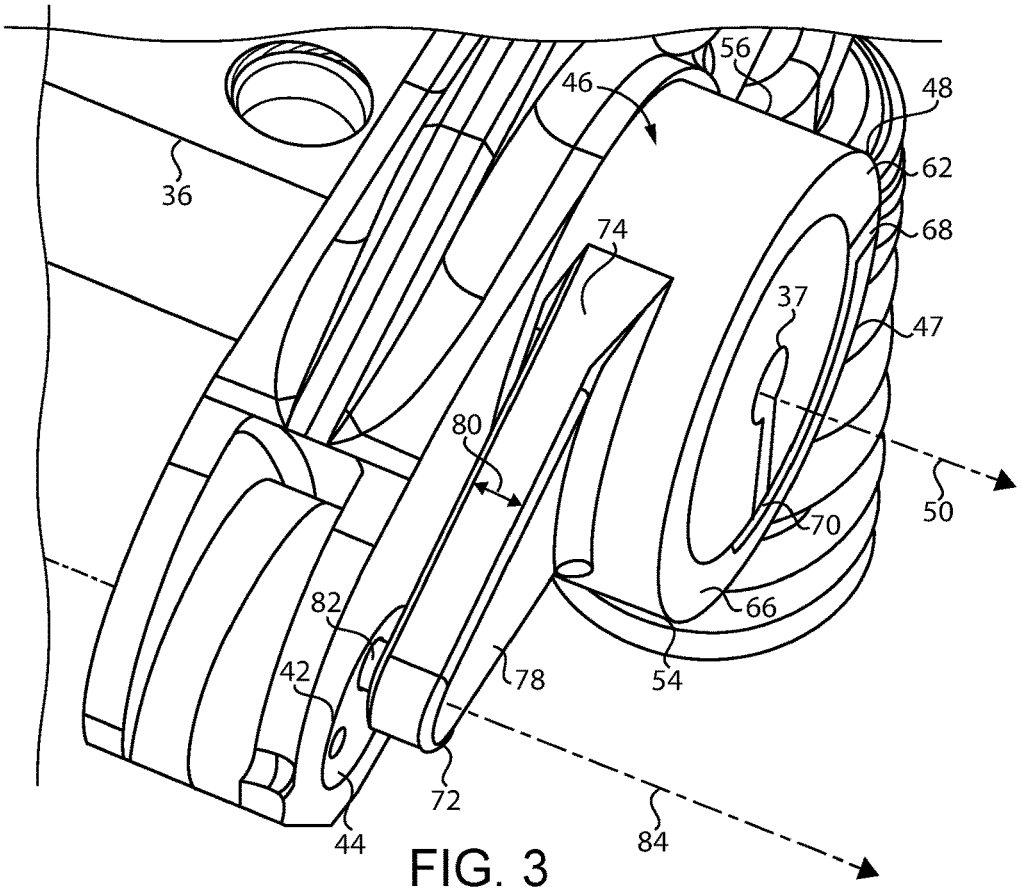
FIG. 3 is perspective view of a rocker arm assembly, according to one embodiment.

Referring also now to FIGS. 2 and 3, there are shown additional features of valvetrain 10 mounted generally above and upon a cylinder head 32 of engine 12. Camshaft 28 includes a plurality of cam lobes 34, rotatable with camshaft 28 about camshaft axis 30. Camshaft 28 may be rotated by way of an engine geartrain (not shown). Engine 12 also includes a rocker shaft 36 having a longitudinally extending oil supply passage 37 to supply an oil such as engine oil for lubrication and cooling. Rocker shaft 36 provides lubrication and cooling to various components in engine 12, such as rocker arms 38, by guiding oil. Positioned upon rocker shaft 36 is a rocker arm 38, one of a plurality of rocker arms in valvetrain 10, designed to pivotably move in response to the rotation of camshaft 28. A roller 40 is supported in rocker arm 38 and positioned adjacent camshaft 28, and structured for direct contact with a cam lobe 34 as cam lobe 34 rotates concurrently with camshaft 28. Rocker arm 38 may include therein a pin bore 42 formed, for example, in a bushing 44, discussed further subsequently. It should be understood within the context of the present disclosure that there may exist in valvetrain 10 a plurality of rocker arms 38 and potentially a plurality of spacers as further discussed herein each positioned adjacent to at least one rocker arm, and potentially each positioned between two rockers arms.

Figure 4:
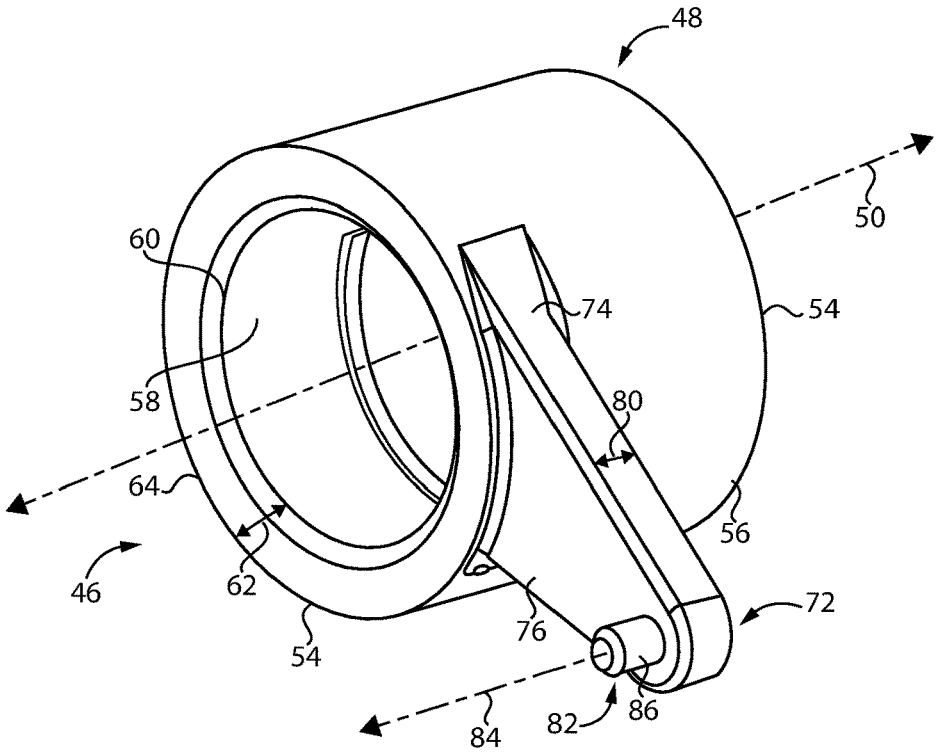
FIG. 4 is a perspective view of a spacer for a valvetrain in an engine system, according to one embodiment.

Also illustrated in FIGS. 2 and 3 is a spacer 46 for valvetrain 10, positioned upon rocker shaft 36 and adjacent one of the plurality of rocker arms 38. Referring now also to FIG. 4, a spacer 46 may include a one-piece spacer body 47. Hereafter, the terms "spacer" and "spacer body" are used, at times, interchangeably. Spacer 46 may include a first body portion 48 defining a spacer axis 50 extending between a first axial spacer body end 52 and a second axial spacer body end 54. First body portion 48 may include a circumferentially extending outer peripheral surface 56 having a cylindrical portion, and a circumferentially extending inner peripheral surface 58 forming a through-bore 60. Rocker shaft 36 is structured to extend through through-bore 60 when spacer 46 is installed in valvetrain 10 for service. A radial distance between outer peripheral surface 56 and inner peripheral surface 58 is shown at numeral 62. Outer peripheral surface 56 and inner peripheral surface 58 may further extend to a first axial end surface 64 and a second axial end surface 66. Both first axial end surface 64 and second axial end surface 66 could be planar and oriented perpendicular relative to spacer axis 50.

As suggested above, valvetrain 10 is configured for supplying oil for lubrication and cooling. To this end, spacer 46 may include an oil spray port 68. Oil spray port 68 may be located axially between first axial spacer body end 52 and second axial spacer body end 54. Oil spray port 68 may extend radially from inner peripheral surface 58 to outer peripheral surface 56, and is structured to spray oil onto surfaces of various parts of valvetrain 10. Spacer 46 may also include a circumferentially extending fluid groove 70 adapted to fluidly connect longitudinally extending oil supply passage 37 to oil spray port 68. Fluid groove 70 may be formed in inner peripheral surface 58. The fluid connection established by fluid groove 70 facilitates movement of oil in rocker shaft 36 to oil spray port 68. An orientation and/or a circumferential length of fluid groove 70 may be contingent upon the placement of oil spray port 68 relative to oil passage 37. For example, fluid groove 70 may extend less than 360° around spacer axis 50 in one configuration, and in a refinement fluid groove 70 may extend less than 180°. In one practical implementation, fluid groove 70 could extend less than 120°, and potentially may extend approximately 90° or less. Approximately can be understood herein to mean within measurement error. While the present description discusses fluid groove 70 being formed in the inner peripheral surface 58 of spacer 46, it may be appreciated that fluid groove 70 could have a variety of forms, including placement of fluid groove 70 in rocker shaft 36, or in part in spacer 46 and in part in rocker shaft 36. Spacer 46 and/or rocker shaft 36 might be equipped with multiple fluid grooves 70 in some embodiments and/or fluid grooves that advance in not only a circumferential direction but also an axial direction.

Spacer 46 may also include a second body portion 72 coupled to first body portion 48. Second body portion 72 may include a spacer arm 74 extending outwardly from first body portion 48 in a direction transverse to spacer axis 50. Spacer arm 74 couples spacer 46 to rocker arm 38 in the illustrated embodiment. As illustrated, spacer arm 74 is positioned closer to first axial spacer body end 52 than to second axial spacer body end 54, although variations to spacer arm 74 position may be implemented such that spacer arm 74 is closer to second axial spacer body end 54, or positioned equidistant first axial spacer body end 52 and second axial spacer body end 54.

Second body portion 72 may include a first outer surface 76 and a second outer surface 78, both extending from first body portion 48. First outer surface 76 and second outer surface 78 may each define a triangular pattern, with second body portion 72 having an overall generally triangular shape as illustrated. First outer surface 76 may face rocker arm 38 and extends in a direction perpendicular to spacer axis 50. Second outer surface 78 also extends in a direction perpendicular to spacer axis 50 and may face a direction opposite first outer surface 76. An axial thickness 80 is defined between first outer surface 74 and second outer surface 76.

Spacer arm 74 may further include a pin 82 defining a rocker engagement axis 84 oriented in a direction parallel spacer axis 50. Pin 82 may further include a rocker engagement surface 86 circumferentially extending around rocker engagement axis 84. Pin 82 is structured and dimensioned to extend into pin bore 42, coupling spacer 46 to rocker arm 38 as rocker arm 38 pivots about rocker shaft 36. Although the current disclosure discusses spacer 46 including pin 82, variations are contemplated in which rocker arm 38 includes pin 82 and spacer 46 includes pin bore 42. Spacer 46 and/or rocker arm 38 may have various other configurations of a pin or other protrusion, or a fastener, that couples the respective components together, such as a non-cylindrical protrusion on one of spacer 46 or rocker arm 38 that is received in a mating void in the other of spacer 46 or rocker arm 38.

INDUSTRIAL APPLICABILITY

As explained above, certain engine platforms, including existing engines removed from service in the field or newly built engines that are originally purpose-built for operation on one fuel type can be modified for operation on a different fuel type. One example includes modifications to an existing diesel engine platform to operate on natural gas or another gaseous fuel, such as hydrogen or various gaseous fuel blends. Adjustments for such a modification can include the removal of valvetrain components previously used to actuate a diesel fuel injector, including a dedicated injector rocker arm, rendering packaging space available that was previously occupied by a fuel injector and rocker arm. Moreover, any such modification to an engine, and notably transitioning from diesel to gaseous fuel, can alter the cooling and lubrication requirements. During operation of engine 12, combustion of a mixture of air and fuel causes engine 12 to generate heat. In the case of gaseous fuel engines, cooling and lubrication requirements may be greater than in the case of diesel engines given that the fuel itself has little, if any, contribution to such purposes.

In a practical implementation, valvetrain 10 may include a plurality of spacers 46 positioned upon rocker shaft 36 and between two rocker arms 38. Spacers 46 can assist in maintaining spacing between components in valvetrain 10, occupying available space that would have been taken up by a rocker arm for a fuel injector in a prior system, and also providing a conduit for spraying engine oil pumped through valvetrain 10 onto various components. In the course of operation, oil is pressurized and circulated and exchanges heat with metal surfaces of engine 12, and carries away the heat to be dissipated while simultaneously ensuring the moving parts of the engine 12 remain lubricated. In the illustrated embodiment, pressurized oil travels through rocker shaft 36 by way of oil supply passage 37, to fluid groove 70, and is sprayed out of each respective spacer via oil spray port 68, lubricating and cooling components within valvetrain 10, including valve springs, valve stems, etc. Valvetrain 10 or components thereof such as spacer 46 can be sold, for example, as original equipment on a newly built engine or provided as aftermarket equipment for replacement or modification of a valvetrain in an existing engine system.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A valvetrain assembly comprising:

a camshaft;

a rocker shaft including an axially extending oil supply passage;

a plurality of rocker arms pivotally mounted to the rocker shaft;

a spacer pivotally mounted to the rocker shaft at a position adjacent to a first rocker arm of the plurality of rocker arms, the spacer including:

a cylindrical outer surface, a cylindrical inner surface defining a through-bore configured to receive the rocker shaft, an oil spray port extending from the inner surface to the outer surface, and a spacer arm extending transversely away from the outer surface, the spacer arm including a rocker engagement surface configured to engage the first rocker arm so as to rotationally couple the spacer to the first rocker arm when pivoting about the rocker shaft; and a circumferentially extending fluid groove defined between the inner surface and the rocker shaft, the fluid groove configured to fluidly connect the oil supply passage to the oil spray port.

2. The valvetrain assembly of claim 1 wherein the rocker engagement surface extends parallel to the rocker shaft.

3. The valvetrain assembly of claim 2 wherein the spacer arm further includes a pin defining the rocker engagement surface, and wherein the first rocker arm includes a pin bore configured to receive the pin.

4. The valvetrain assembly of claim 3 wherein the spacer arm extends from the outer surface at an axial position between the first rocker arm and a central axial position of the spacer.

5. The valvetrain assembly of claim 1 wherein the fluid groove is formed in the inner surface of the spacer.

6. A rocker arm assembly comprising:

a rocker arm; and a spacer with a spacer body including:

a first body portion including a cylindrical outer surface, a cylindrical inner surface defining a through-bore extending along a spacer axis, an oil spray port extending from the inner surface to the outer surface, and a circumferentially extending fluid groove formed in the inner surface so as to extend to the oil spray port; and a second body portion including an arm extending outwardly from the outer surface, the second portion configured to couple the spacer to the rocker arm.

7. The rocker arm assembly of claim 6 wherein the second body portion further includes a rocker engagement surface extending parallel to the spacer axis.

8. The rocker arm assembly of claim 7 wherein the second body portion further includes a pin defining the rocker engagement surface, and wherein the rocker arm includes a bushing defining a pin bore configured to receive the pin.

9. The rocker arm assembly of claim 8 further comprising a rocker shaft, wherein the spacer is coupled to the rocker arm so as to collectively pivot about the rocker shaft.

10. A spacer for a valvetrain in an engine system, the spacer comprising:

a spacer body including:

a first axial end surface, a second axial end surface, a cylindrical outer surface, a cylindrical inner surface defining a through-bore extending from the first axial end surface to the second axial end surface along a spacer axis, an oil spray port extending from the inner surface to the outer surface, a circumferentially extending fluid groove formed in the inner surface so as to extend to the oil spray port; and an arm extending transversely away from the outer surface, the arm including a rocker engagement surface.

11. The spacer of claim 10 wherein the arm further includes a cylindrical pin defining the rocker engagement surface which extends parallel to the spacer axis.

12. The spacer of claim 10 wherein the first axial end surface and the second axial end surface each extend perpendicular to the spacer axis.

13. The spacer of claim 10 wherein the arm is positioned closer to the first axial end surface than to the second axial end surface, and the fluid groove.

14. The spacer of claim 13 wherein the fluid groove is axially offset from the arm.

15. The spacer of claim 10 wherein the arm is defined by a triangular first end face and a triangular second end face.

16. The spacer of claim 10 wherein the fluid groove extends less than 360° about the spacer axis.

17. The spacer of claim 16 wherein the fluid groove extends less than 180° about the spacer axis.

* * * * *